US005311958A

United States Patent [19]

Isbell et al.

[11] Patent Number: 5,311,958

[45] Date of Patent: May 17, 1994

[54] EARTH-BORING BIT WITH AN ADVANTAGEOUS CUTTING STRUCTURE

[75] Inventors: Matthew R. Isbell; Rudolf C. O. Pessier, both of Houston, Tex.

[73] Assignee: Baker Hughes Incorporated, Houston, Tex.

[21] Appl. No.: 949,660

[22] Filed: Sep. 23, 1992

[51] Int. Cl.[5] ..... E21B 10/14

[52] U.S. Cl. ..... 175/341; 175/374; 175/376; 175/378

[58] Field of Search ..... 175/331, 341, 336, 351, 175/374, 376, 378; 299/86

[56] References Cited

U.S. PATENT DOCUMENTS

| | | | |
|---|---|---|---|
| 1,896,251 | 2/1933 | Scott . | |
| 2,086,486 | 7/1937 | Woods | 175/336 X |
| 2,177,332 | 10/1939 | Reed | 175/378 X |
| 2,333,746 | 11/1943 | Scott et al. . | |
| 2,363,202 | 11/1944 | Scott . | |
| 2,527,838 | 10/1950 | Morlan et al. . | |
| 2,533,257 | 12/1950 | Woods et al. . | |
| 2,533,258 | 12/1950 | Morlan et al. . | |
| 2,533,259 | 12/1950 | Woods et al. . | |
| 2,533,260 | 12/1950 | Woods et al. . | |
| 2,759,706 | 8/1956 | Peter | 175/378 |
| 2,804,282 | 8/1957 | Spengler, Jr. . | |
| 2,887,302 | 5/1959 | Garner . | |
| 2,907,551 | 10/1959 | Peter . | |
| 2,939,684 | 6/1960 | Payne | 175/378 X |
| 2,965,184 | 12/1960 | Morlan . | |
| 3,104,726 | 9/1963 | Davis | 175/331 |
| 3,397,751 | 8/1968 | Reichmuth | 175/341 |
| 3,412,817 | 11/1968 | Reichmuth | 175/341 |
| 3,946,820 | 3/1976 | Knapp | 175/341 |

*Primary Examiner*—Ramon S. Britts
*Assistant Examiner*—Roger J. Schoeppel
*Attorney, Agent, or Firm*—Robert A. Felsman; Mark D. Perdue

[57] ABSTRACT

An earth-boring bit is provided with three cutters, two of the three cutters are provided with heel disk cutting elements defined by a pair of generally oppositely facing disk surfaces that generally continuously converge to define a circumferential heel disk crest. One of the two cutters having heel disk elements is further provided with an inner disk cutting element.

21 Claims, 5 Drawing Sheets

EARTH-BORING BIT WITH AN ADVANTAGEOUS CUTTING STRUCTURE

BACKGROUND OF THE INVENTION

1. Field of the Invention

This invention relates generally to earth-boring drill bits, and particularly to improved cutting structures therefor.

2. Background Information

The success of rotary drilling enabled the discovery of deep oil and gas reservoirs. The rotary rock bit was an important invention that made the success of rotary drilling possible. Only soft earthen formations could be commercially penetrated with the earlier drag bit, but the two cone rock bit, invented by Howard R. Hughes, U.S. Pat. No. 930,759, drilled the hard caprock at the Spindletop Field, near Beaumont, Tex., with relative ease. That venerable invention, within the first decade of this century, could drill a scant fraction of the depth and speed of the modern rotary rock bit. If the original Hughes bit drilled for hours, the modern bit drills for days. Modern bits sometimes drill for thousands of feet instead of merely a few feet. Many advances have contributed to the impressive improvement of rotary rock bits.

In drilling boreholes in earth formations by rotary method, rotary rock bits fitted with one, two, or three rolling cutters, rotatably mounted thereon, are employed. The bit is secured to the lower end of a drill string that is rotated from the surface or by downhole motors or turbines. The cutters mounted on the bit roll upon the bottom of the borehole as the drill string is rotated, thereby engaging and disintegrating the formation material to be removed. The roller cutters are provided with teeth that are forced to penetrate and gage the bottom of the borehole by weight from the drill string.

The cuttings from the bottom and sides of the well are washed away by drilling fluid that is pumped down from the surface through the hollow, rotating drill string, and are carried in suspension in the drilling fluid to the surface. The form and location of the teeth upon the cutters have been found to be extremely important to the successful operation of the bit. Certain aspects of the design of the cutters becomes particularly important if the bit is to penetrate deeply into a formation to effectively strain and induce failure in more plastically behaving rock formations such as shales, siltstones, and chalks.

In drilling shales and siltstones, which are the dominant lithologies in oil well drilling, and other earthen formations, two problems frequently arise. One problem, known as "tracking," occurs when the teeth of a cutter fall in the same indentation that was made on the previous revolution of the bit. When this occurs, the teeth of the cutters on the bit are said to "track." Tracking causes the formation of large hills and valleys, known as "rock teeth," on the bottom of the borehole. Rock teeth present a sculptured drilling surface that closely matches the pattern of the teeth of the cutters, making it more difficult for the teeth to reach the virgin rock at the bottom of the valleys. Rock teeth also tend to redistribute the weight on the bit from the crests to the flanks of the cutting teeth, which impedes deep penetration and leads to inefficient material fragmentation, and often to damage to the bit and bit bearings.

The other problem frequently encountered in drilling shales, and other soft earthen formations, is known as "balling." Balling occurs when formation material becomes lodged between the teeth on the cutter of the bit. Balling, like tracking, prevents the teeth of the cutter from penetrating to full depth, thus resulting in inefficient and costly drilling. Balling also prevents the force on the crests of the teeth from reaching a level sufficient to fracture rock.

The characteristics of both tracking and balling are well-recognized, but generally are treated as independent problems. However, in many cases, features that reduce tracking promote balling, and vice-versa. For example, a conventional steel-toothed bit as disclosed in U.S. Pat. No. 1,896,251, Feb. 7, 1933, to Scott, has closely spaced teeth with axial crests intermittently interrupted by wide spaces to reduce the height of rock teeth and the severity of the tracking. Balling is more likely to occur between closely spaced teeth and such teeth are severely limited in their ability to penetrate the formation deeply. U.S. Pat. No. 2,333,746, Nov. 9, 1943, to Scott et al., on the other hand, discloses large and widely spaced teeth with axial crests to minimize balling, particularly in the outermost rows of the earth-boring bit. Such large and widely spaced teeth, however, are prone to tracking and the resulting build up of rock teeth.

There it is a need, therefore, to provide an earth-boring bit having a cutting structure designed to penetrate relatively soft earthen formations rapidly by simultaneously minimizing the occurrence of both tracking and balling.

SUMMARY OF THE INVENTION

It is a general object of the present invention to provide an earth-boring bit of the rolling cone variety having improved ability to penetrate earthen formations. This and other objects of the present invention are accomplished by providing an earth-boring bit having a bit body, the bit body having at least two cutters mounted for rotation on a bearing shaft that depends from the bit body, each cutter having a nose and a base. At least one of the cutters is provided with a heel disk cutting element disposed proximally to the base of the cutter and defined by a pair of generally oppositely facing disk surfaces that generally continuously converge to define a circumferential heel disk crest.

According to a preferred embodiment of the invention, an earth-boring bit is provided with three cutters, two of the three cutters are provided with heel disk cutting elements. One of the two cutters having heel disk elements is further provided with an inner disk cutting element defined by a pair of generally oppositely facing disk surfaces that generally continuously converge to define a circumferential inner disk crest.

Other objects, features, and advantages of the present invention will be apparent to those skilled in the art with reference to the following drawings and detailed description of the preferred embodiment of the present invention.

DESCRIPTION OF THE PREFERRED EMBODIMENT

Figure 1:
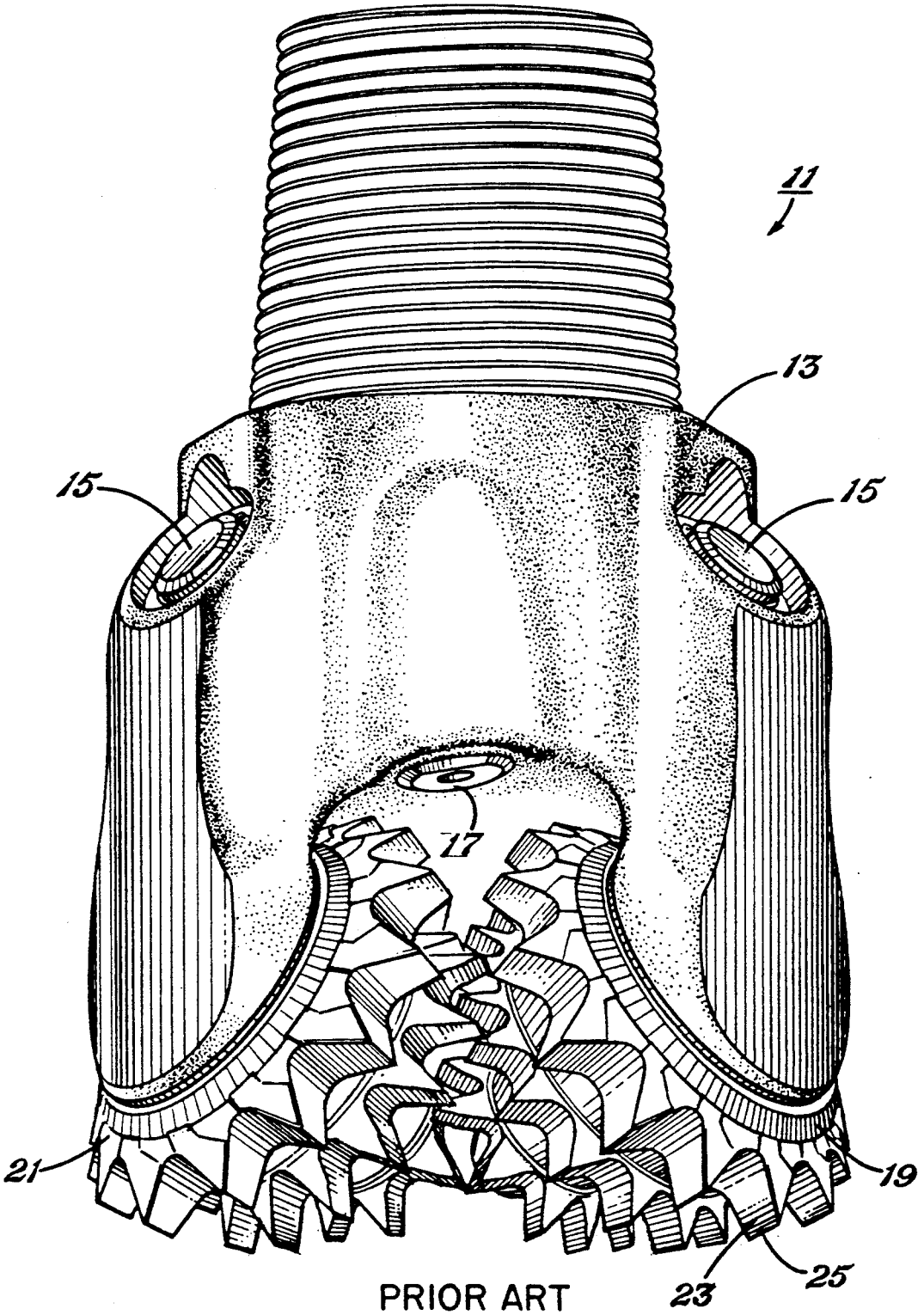
PRIOR ART Fig. 1
FIG. 1 is a perspective view of a prior-art earth-boring bit.

FIG. 1 illustrates a typical prior-art earth-boring bit 11. The prior-art bit 11 illustrated in FIG. 1 shares a number of features in common with the bit according to the present invention. Such a bit 11 is provided with a bit body 13, which is threaded at its upper extent for connection into a drillstring. Bit body 13 is provided with a number of pressure-compensating lubricant reservoirs 15. Bit body 13 is also provided with at least one nozzle 17, which sprays drilling fluid from within the drillstring to cool bit 11 and wash cuttings produced during drilling out of the borehole.

Mounted for rotation on cantilevered bearing shafts (shown as 29 in FIG. 7) depending from bit body 13 are a plurality of cutters 19, 21, in this case three (one of the cutters is obscured from view in the perspective of FIG. 1). Cutters 19 are formed with a plurality of axial teeth 23 having axial crests 25 formed thereon. During drilling operation, cutters 19, 21 roll over the bottom of the borehole being drilled while teeth 23 penetrate and disintegrate the formation. In a typical prior-art earth-boring bit, teeth 23 are provided with axial crests 25. Axial crests are so called because the crests 25 generally are aligned with the centerline or axis of rotation of cutters 19, 21.

The cutting structure of an earth-boring bit 11 is defined as the number and arrangement of teeth 23 and their crests 25. Except for the cutting structure of earth-boring bit 11 illustrated in FIG. 1, the remainder of the bit 11 structure is typical and representative of that contemplated for use with the present invention.

Prior-art bits similar to that illustrated in FIG. 1 have a shortcoming that becomes particularly apparent during drilling of more plastically behaving formation materials, such as shales. During drilling of these formations, conventionally arranged axial teeth 23 tend to fall into indentations made by the same or another tooth 23 on previous revolutions of earth-boring bit 11. This condition is known as tracking and can seriously impair the penetration rate, life, and performance of earth-boring bit 11.

Another shortcoming of a prior-art bit 11 as illustrated in FIG. 1 is that formation material may become packed between teeth 23, thereby preventing teeth 23 from penetrating the formation deeply and thereby reducing the rate of penetration of bit 11. This condition is known as balling, and a bit 11 that is subjected to balling is said to be balled up.

Figure 2:
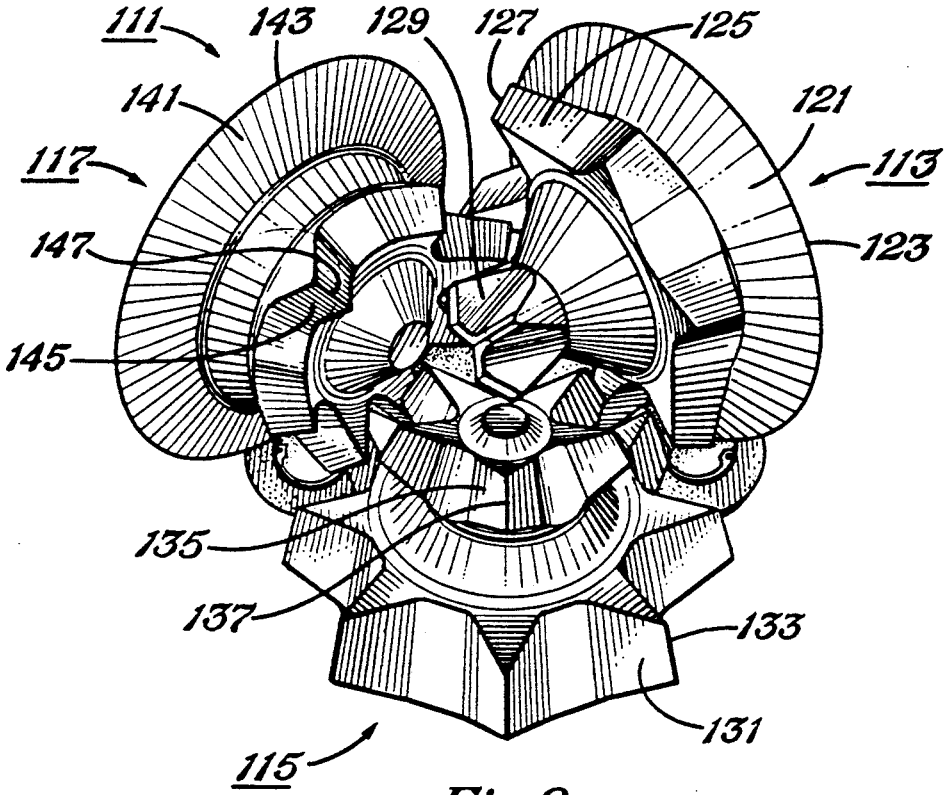
FIG. 2 is a perspective view of the cutters of an earth-boring bit according to the present invention. The cutters of the earth-boring bit are viewed from below, looking upwardly.

Referring now to FIG. 2, an earth-boring bit 111 according to a preferred embodiment of the present invention is depicted. Bit 111 is provided with a plurality of cutters 113, 115, and 117. Each cutter 113, 115, 117 is generally frusto-conical in configuration, and has a nose and a base.

A first cutter 113 is provided with a heel disk cutting element 121 disposed proximally to the base of cutter 113 in what is known as the heel region of cutter 113. Heel disk cutting element 123 is defined by a pair of generally oppositely facing disk surfaces that generally continuously converge to define a single, generally continuous, circumferential heel disk crest 123. Heel disk crest 123 is defined as circumferential, as opposed to axial, because it is oriented circumferentially about cutter 113.

An inner row of axial cutting teeth 125 having axial crests 127 thereon is spaced inwardly of heel disk cutting element 121 and intermediate the nose and base of cutter 113. Hereinafter, teeth having axial crests will be referred to as "axial teeth," as opposed to teeth having circumferential crests, which will be referred to as "circumferential teeth." Cutter 113 is further provided with a spear point 129 on the nose of cutter 113.

A second cutter 115 is provided with an outer, or heel, row of axial teeth 131 having axial crests 133 thereon. According to a preferred embodiment of the present invention, axial teeth 131 on heel row of cutter 115 are provided with variable pitch, or irregular spacing, and tend to minimize tracking conditions. Preferably, the most widely spaced teeth 131 have a pitch approximately one-third to two-thirds larger than the most closely spaced teeth, and widely spaced teeth alternate with more closely spaced teeth.

An inner row of axial teeth 135 having axial crests thereon is disposed inwardly of heel axial teeth 131 and proximal to the nose of cutter 115.

A third cutter 117 is provided with a heel disk cutting element 141, which is defined by a pair of generally oppositely facing disks surfaces that converge to define a single, generally continuous, circumferential heel disk crest 143. Inward of heel disk cutting element 141 is an inner row of teeth 145 having axial crests 147 formed thereon.

Preferably, one of each of the pairs of disk surfaces of heel disk cutting elements 121, 141 is formed of a more wear-resistant material than that of the other of the pair of disk surfaces. This may be accomplished by hardfacing the one disk surface with tungsten carbide, selectively surface hardening the disk surface, or other conventional surface wear-resistance enhancing procedures. The resulting heel disk cutting elements 121, 141 are self-sharpening due to the different wear rates of each of the disk surfaces, and therefore will retain sharp, well-defined heel disk crests 123, 143.

Figure 3:
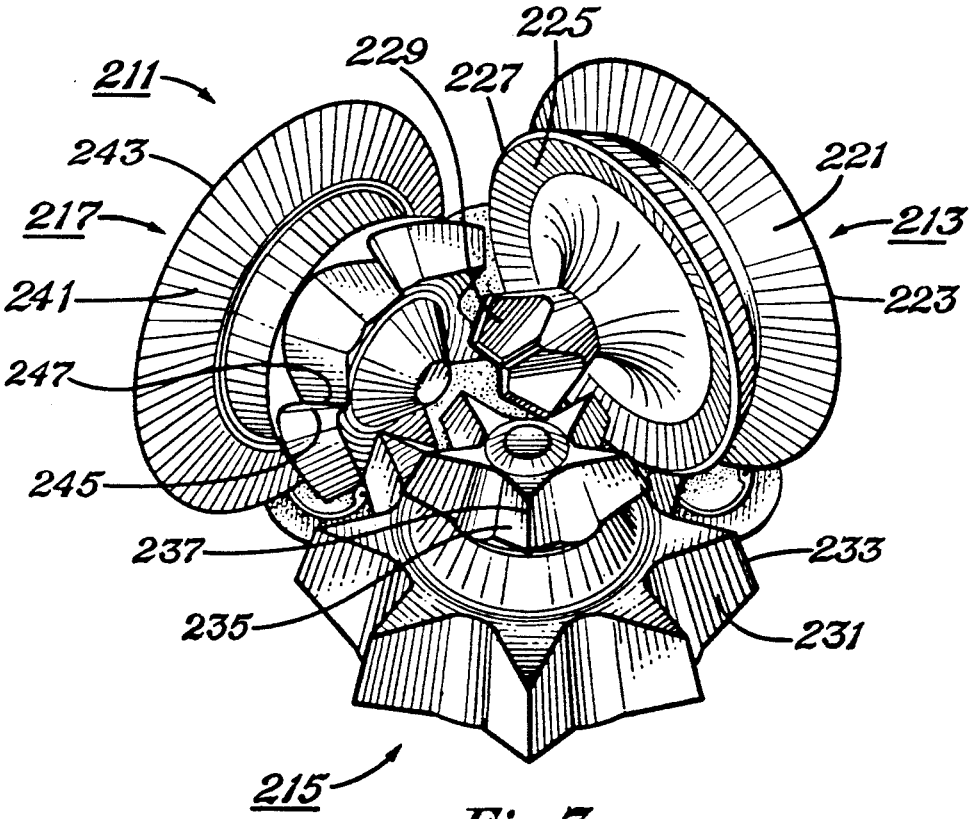
FIG. 3 is a perspective view of the cutters of an earth-boring bit according to the present invention. The cutters of the earth-boring bit are viewed from below, looking upwardly.

With reference now to FIG. 3, an earth-boring bit 211 according to another embodiment of the present invention is illustrated. Bit 211 is provided with at least two, in this case three, cutters 213, 215, 217.

A first cutter 213 is provided with a heel disk cutting element 221, which is defined by a pair of generally oppositely facing disk surfaces that generally continuously converge to define a single, generally continuous, circumferential heel disk crest 223. Heel disk cutting element 221 is disposed proximally to the base of cutter 213. Intermediate the nose and the base of cutter 213, but generally adjacent heel disk cutting element 213, is an inner disk cutting element 225, which is defined by a pair of generally oppositely facing disks surfaces that generally continuously converge to define a circumferential inner disk crest 227. A spear point 229 is provided on the nose of cutter 213.

A second cutter 215 is provided with a circumferential heel row of axial teeth 231, the heel teeth 231 having axial crests 233 formed thereon. Preferably, heel row teeth 231 have a variable pitch in which the most widely spaced teeth have a pitch approximately one-third to two-thirds greater than the most narrowly spaced teeth, and wherein widely spaced teeth alternate with narrowly spaced teeth. Inward of heel row teeth 231 and proximally to the nose of cutter 215 is an inner row of teeth 235. Inner row teeth 235 have axial crests 237 formed thereon.

A third cutter 217 is provided with a heel disk cutting element 241, which is defined by a pair of generally oppositely facing disks surfaces that converge to define a single, generally continuous, circumferential heel disk crest 243. Heel disk cutting element 241 is disposed proximally to the base of cutter 217. Inward from heel disk cutting element 241 is a row of teeth 245, each tooth having a axial crest 247 formed thereon.

Preferably, one of each of the pairs of disk surfaces of disk cutting elements 221, 225, 241 is formed of a more wear-resistant material than that of the other of each pair of disk surfaces. This may be accomplished by hardfacing the disk surface with tungsten carbide, selectively surface hardening the disk surface, or other conventional surface wear-resistance enhancing procedures. The resulting disk cutting elements 221, 225, 241 will be self-sharpening due to the different wear rates of each of the disk surfaces, and will retain sharp, well-defined disk crests 223, 227, 243.

Inward from heel disk cutting element 241 is a row of axial teeth 245, each tooth having a axial crest 247 formed thereon.

Figure 4:
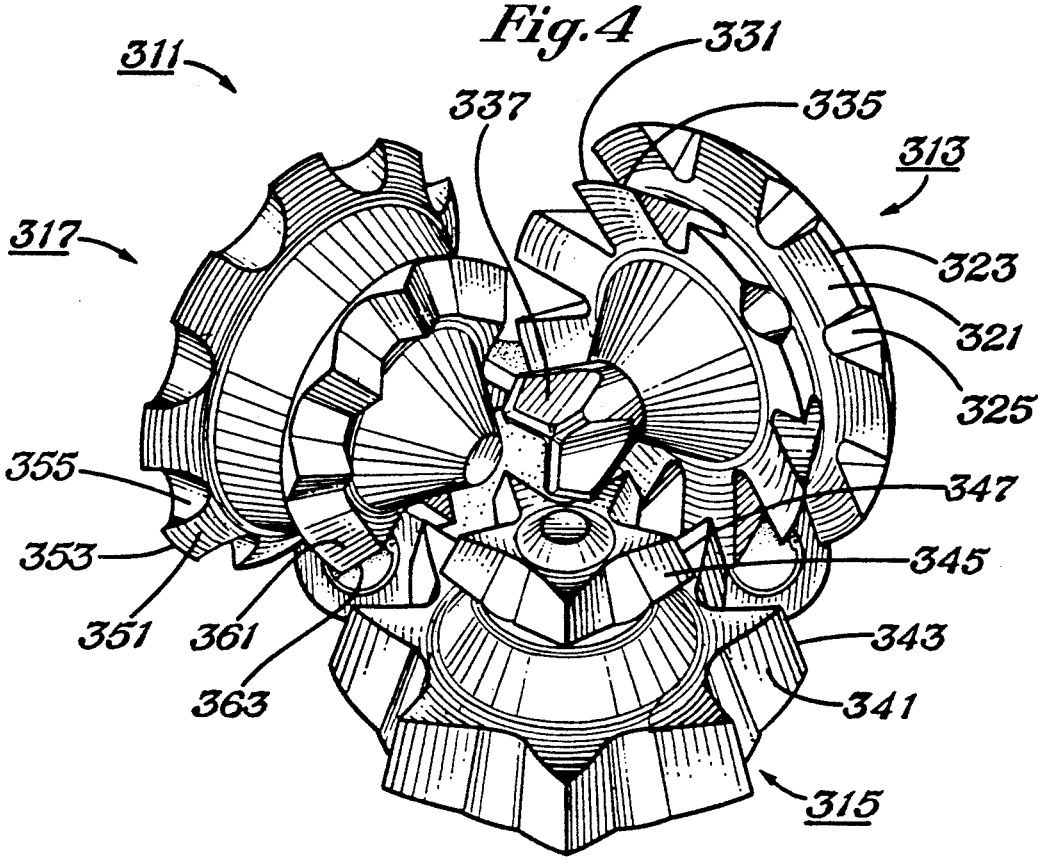
FIG. 4 is a perspective view of the cutters of an earth-boring bit according to the present invention. The cutters of the earth-boring bit are viewed from below, looking upwardly.

FIG. 4 illustrates an earth-boring bit 311 according to another preferred embodiment of the present invention. Bit 311 is provided with at least two, in this case three, cutters 313, 315, and 317. A first cutter 313 is provided with an interrupted heel disk cutting element 321. Interrupted heel disk cutting element 321 is defined by a pair of disks surfaces that generally continuously converge to define a circumferential heel disk crest 323.

Interrupted heel disk cutting element 321 is further provided with a plurality of interruptions 325, which provides interrupted heel disk cutting element 321 with a more aggressive cutting structure. This more aggressive cutting structure permits increased rates of formation material removal and provides spaces to permit cuttings to move more easily from the outer perimeter of the borehole to the interior of the borehole, and vice-versa, promoting efficient removal of cuttings from the borehole. Interrupted heel disk cutting element 321 provides bit 311 according to the present invention with an improved rate of penetration into earthen formations, and tends to reduce the occurrence of bit balling and tracking.

Intermediate the nose and the base of cutter 313, and generally adjacent the interrupted heel disk cutting element 323, is an interrupted inner disk cutting element 331, which is defined by a pair of generally oppositely facing disk surfaces that generally continuously converge to define a circumferential inner disk crest 333. Interrupted inner disk cutting element 331 is further provided with a plurality of interruptions 335 to further define a plurality of individual circumferential cutting teeth 331, each cutting tooth 331 having a single circumferential crest 333. A spear point 337 is disposed on the nose of cutter 313.

A second cutter 315 is provided with a circumferential heel row of axial teeth 341 having axial crests 343 thereon. As with the embodiments illustrated in FIGS. 2 and 3, heel teeth 343 should be formed with a variable pitch as described herein. Inward of heel row of teeth 341, and proximally to the nose of cutter 315 is an inner row of axial teeth 345 having axial crests 347 formed thereon.

A third cutter 317 has an interrupted heel disk cutting element 351 formed proximally to the base of cutter 317. Interrupted heel disk cutting element is defined by a pair of generally oppositely facing disk surfaces that converge to define a circumferential heel disk crest 353. Interrupted heel disk cutting element 351 is further provided with a plurality of interruptions 355, which define a plurality of individual cutting teeth, each tooth having a single circumferential heel disk crest. The function of interrupted heel disk cutting element 351 is substantially as described herein.

Preferably, one of each of the pairs of disk surfaces of disk cutting elements 321, 331, 351 is formed of a more wear-resistant material than that of the innermost of each pair of disk surfaces. This may be accomplished by hardfacing the disk surface with tungsten carbide, selectively surface hardening the disk surface, or other conventional surface wear-resistance enhancing procedures. The resulting heel disk cutting elements 321, 331, 351 are self-sharpening due to the different wear rates of the disk surfaces, and will retain sharp, definite heel disk crests 323, 333, 353.

Inward from interrupted heel disk cutting element 351, and intermediate the nose and the base of cutter 317, is an inner row of cutting axial teeth 361, each cutting tooth 361 having a axial crest formed thereon.

Figure 8:
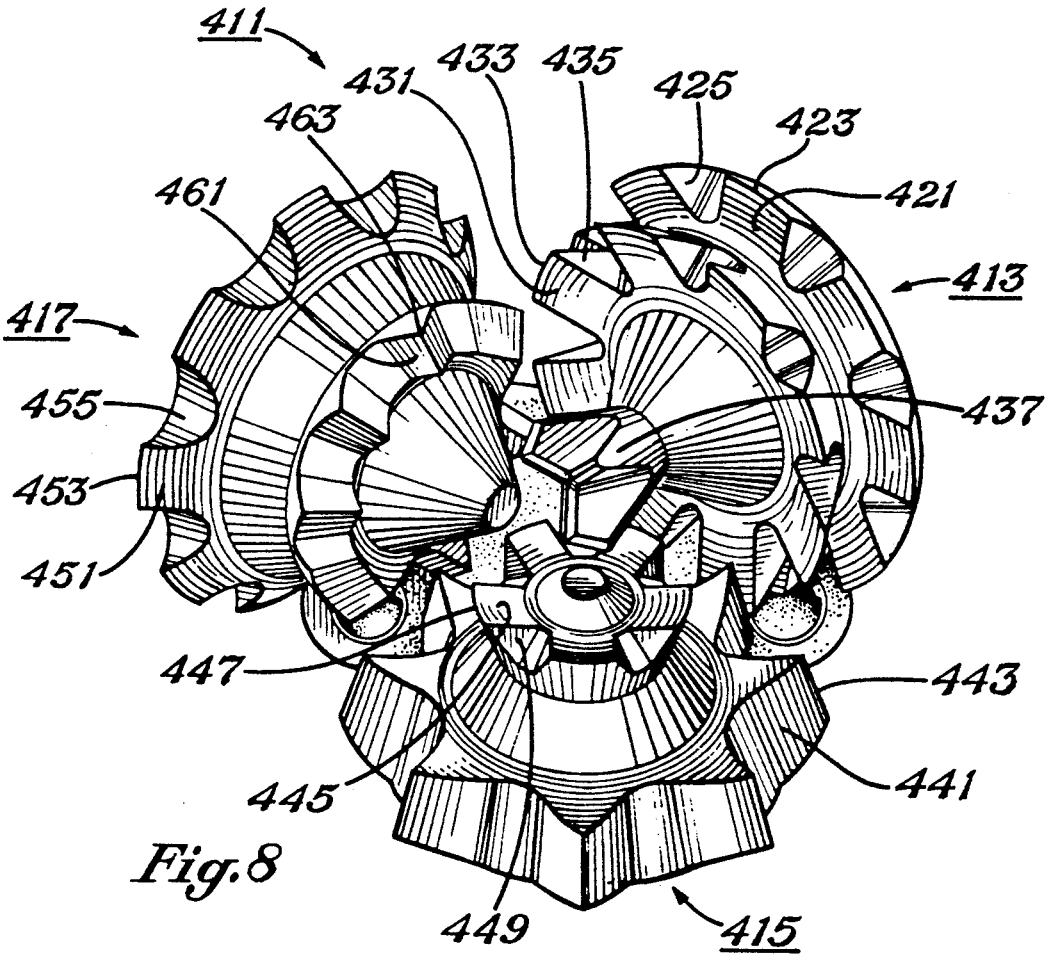
FIG. 8 is a perspective view of the cutters of an earth-boring bit according to the present invention. The cutters of the earth-boring bit are viewed from below, looking upwardly.

FIG. 8 illustrates an earth-boring bit 411 according to another preferred embodiment of the present invention. Bit 411 is provided with at least two, in this case three, cutters 413, 415, and 417. A first cutter 413 is provided with an interrupted heel disk cutting element 421. Interrupted heel disk cutting element 421 is defined by a pair of disks surfaces that generally continuously converge to define a circumferential heel disk crest 423.

Interrupted heel disk cutting element 421 is further provided with a plurality of interruptions 425, which provides interrupted heel disk cutting element 421 with a more aggressive cutting structure. This more aggressive cutting structure permits increased rates of formation material removal and provides spaces to permit cuttings to move more easily from the outer perimeter of the borehole to the interior of the borehole, and vice-versa, promoting efficient removal of cuttings from the borehole. Interrupted heel disk cutting element 421 provides bit 411 according to the present invention with an improved rate of penetration into earthen formations, and tends to reduce the occurrence of bit balling and tracking.

Intermediate the nose and the base of cutter 413, and generally adjacent the interrupted heel disk cutting element 423, is an interrupted inner disk cutting element 431, which is defined by a pair of generally oppositely facing disk surfaces that generally continuously converge to define a circumferential inner disk crest 433. Interrupted inner disk cutting element 431 is further provided with a plurality of interruptions 435 to further define a plurality of individual circumferential cutting teeth 431, each cutting tooth 431 having a single circumferential crest 433. A spear point 437 is disposed on the nose of cutter 413.

A second cutter 415 is provided with a circumferential heel row of axial teeth 441 having axial crests 443 thereon. As with the embodiments illustrated in FIGS. 3 and 4, heel teeth 441 should be formed with a variable pitch as described herein. Inward of heel row of teeth 441, and proximally to the nose of cutter 415 is an interrupted inner disk element 445, which is defined by a pair of generally oppositely facing disk surfaces that converge to define a circumferential inner disk crest 447. Inner disk element 445 is also provided with a plurality of interruptions 449.

A third cutter 417 has an interrupted heel disk cutting element 451 formed proximally to the base of cutter 417. Interrupted heel disk cutting element is defined by a pair of generally oppositely facing disk surfaces that converge to define a circumferential heel disk crest 453. Interrupted heel disk cutting element 451 is further provided with a plurality of interruptions 455, which define a plurality of individual cutting teeth, each tooth having a single circumferential heel disk crest. The function of interrupted heel disk cutting element 451 is substantially as described herein.

Preferably, one of each of the pairs of disk surfaces of disk cutting elements 421, 431, 451, 445 is formed of a more wear-resistant material than that of the innermost of each pair of disk surfaces. This may be accomplished by hardfacing the disk surface with tungsten carbide, selectively surface hardening the disk surface, or other conventional surface wear-resistance enhancing procedures. The resulting disk cutting elements 421, 431, 445, 451 are self-sharpening due to the different wear rates of the disk surfaces, and will retain sharp, definite heel disk crests 423, 433, 447, 453.

According to the preferred embodiment of the present invention illustrated in FIGS. 2 through 4 and 8, earth-boring bits 111, 211, 311, 411 are of the milled tooth variety, wherein the various aspects of the cutting structure are formed conventionally using steel milling techniques.

Figure 5:
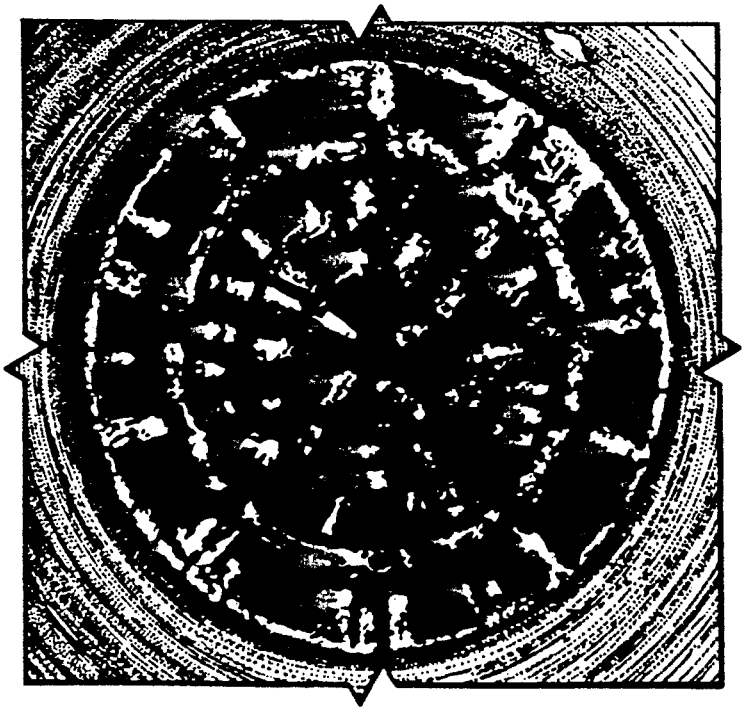
FIG. 5 is a plan view of a bottom hole pattern generated by an earth-boring bit according to the present invention.
Figure 6:
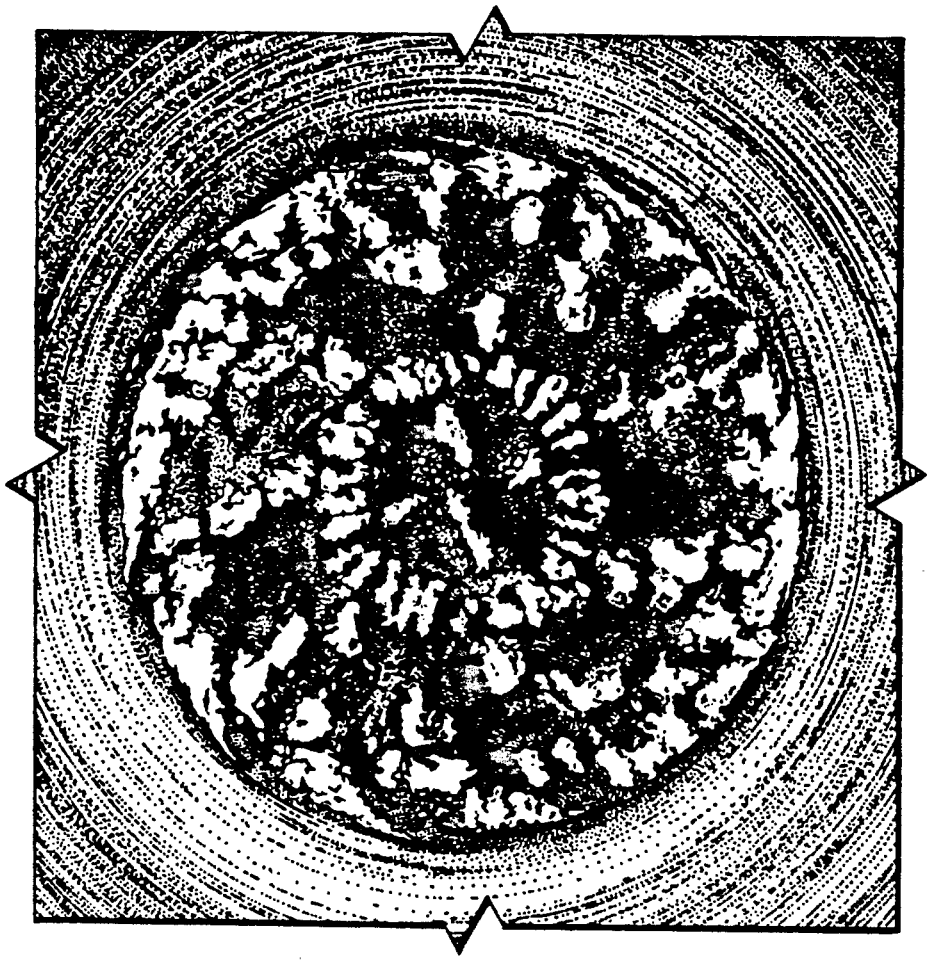
FIG. 6 is a plan view of a bottom hole pattern generated by a prior-art earth-boring bit.
Figure 7:
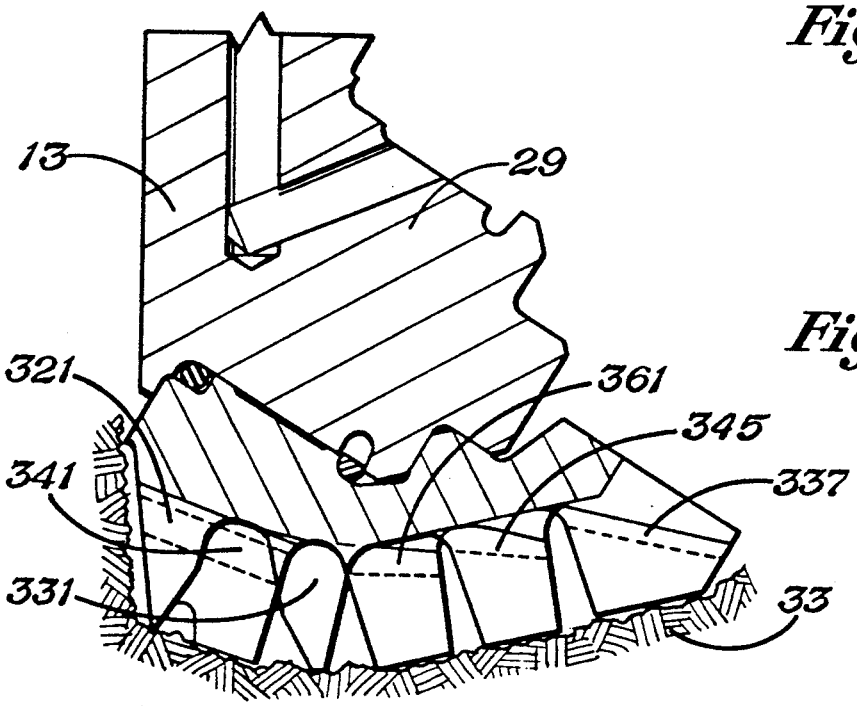
FIG. 7 is a fragmentary, enlarged section view of an earth-boring bit that schematically illustrates the cutting profile of an earth-boring bit according to the present invention defined by the cutters and teeth thereon relative to the borehole.

With reference to FIGS. 5, 6, and 7, the operation of the earth-boring bit 311 according to the present invention will be discussed. FIG. 5 is a plan view of a bottom hole pattern generated by an earth-boring bit 311 according to the present invention. In the center of FIG. 5 and extending radially outward therefrom, is the part of the simulator test core that was operated on by earth-boring bit 311. Lighter portions of the pattern represent tooth marks that left behind a quantity of crushed formation material, and the darker portions indicate virgin formation. The irregularity of the center of the pattern indicates a lack of the deleterious tracking condition. In the outer or heel region of the pattern, the axial tooth impressions are relatively far apart, but are bounded by concentric grooves left by disk cutting elements 321, 331, 351. The presence of disk cutting elements 321, 331, 351, assures that the formation is disintegrated in a highly efficient manner.

The cutting and disintegrating action of the circumferential crests 323, 333, 353, of disk cutting elements 321, 331, 351, cooperate with and complement the cutting and disintegrating action of the axial teeth in the outer and heel rows. The result of this cooperation and complementary action is an earth-boring bit with an improved rate of penetration into earthen formations and reduced susceptibility to bit tracking and bit balling conditions.

FIG. 6 is a plan view of a bottom hole pattern generated by a prior-art earth-boring bit (shown as 11 in FIG. 1). In the center of FIG. 6 and extending radially outward therefrom is the part of the boring mill test piece that was operated on by a prior-art earth-boring bit 11. Lighter portions of the pattern represent tooth marks that left behind a quantity of crushed formation material and the darker portions indicate virgin formation. The regular and wide spacing of the pattern cut in the test piece indicates the presence of a tracking condition, which leaves large sections of uncut bottom that may develop into rock teeth. Rock teeth result from tracking, in which teeth 23 on cutters 19, 21 of earth-boring bit 11 fall into the same indentation or penetration made by the tooth on the previous revolution of earth-boring bit 11. Such a tracking condition, and the resulting rock teeth, prevent earth-boring bit 11 from fully, efficiently, and quickly penetrating and disintegrating formation material. Because the rock teeth present an extremely uneven drilling surface, bit 11, and its cutters 19, 21 and their bearings, may be exposed to larger transient or shock loads, which tend to cause premature failure of bit 11. Additionally, because teeth 23 penetrate an indentation previously formed rather than making a fresh or offset indentation, the disintegrating action of teeth 23 is blunted and less efficient because the weight on earth-boring bit 11 is distributed to the flanks of teeth 23, rather than their crests.

A great redundancy in tooth impressions characterizes the outermost or heel portion of the bottom hole pattern of FIG. 6. This redundancy is not necessarily beneficial, but is an indicator of inefficient rock disintegration because it produces finer particles of disintegrated material, which may impede the mechanical drilling process and the hydraulic cleaning of the borehole.

FIG. 7 is an enlarged, fragmentary section view of an earth-boring bit according to the present invention that schematically illustrates the cutting profile defined by such a bit relative to a borehole 33 being drilled. Illustrated is a schematic representation of the superimposition of the various cutting elements and teeth 321, 331, 337, 341, 345, 361 of each cone 313, 315, 317 of the embodiment of the present invention illustrated in FIG. 4. The illustration of FIG. 4 depicts the relationship of the rows of teeth of one cone to those of other cones. It will be appreciated, however, that the operation described herein with reference to FIG. 7 applies equally to the embodiments illustrated in FIGS. 2, 3 and 8.

Depending from bit body 13 is a bearing shaft 29, which is illustrated as a cylindrical journal bearing having snap ring retention means to retain cutters on bearing shaft 29. Individual cutters 313, 315, 317 are not illustrated in favor of a superimposition of the teeth of each cutter 313, 315, 317 in engagement with borehole 33.

Outermost and adjacent the gage or outermost diameter of borehole 33 is heel disk cutting element 321 of cutter 313, and heel disk cutting element 351 (not shown) of cutter 315. Heel row of axial teeth 341 of cutter 315 overlaps and extends inwardly beyond heel disk cutting element 321. Inner disk cutting element 331 of cutter 313 is inward of and adjacent heel row of axial cutting teeth 341. Inner row of axial cutting teeth 361 of cutter 317 is inward of and adjacent to inner disk cutting element 331. Inner row of axial cutting teeth of 345 of cone 315 is inward of and adjacent to inner row of cutting teeth 361. Spear point 337 of cone 313 is innermost and adjacent to inner row of axial cutting teeth 345.

As illustrated in FIG. 7, cutting elements and teeth 321, 331, 337, 341, 345, 361 intermesh and interfit to define a cutting profile with respect to the bottom of borehole 33. The preferred cutting profile is obtained where the circumferential crests of disk cutting elements 321, 331, 351 do not extend substantially beyond the axial crests of cutting teeth 321, 331, 337, 341, 345, 361.

The interfitting arrangement of disk cutting elements 321, 331, 337 with heel and inner rows of teeth 337, 341, 345, 361 having axial crests cooperate together to create an improved cutting action on the bottom and gage of the borehole 33. As the bit rotates, the cutters roll and slide over the bottom of borehole 33, permitting cutting elements and teeth 321, 331, 337, 341, 345, 361 to engage, penetrate, and disintegrate borehole 33. The circumferential crests of disk elements 321, 331, 351 circumscribe a relatively narrow path adjacent and overlapping the widely spaced impressions left by the remainder of the rows of axial cutting teeth 337, 341, 345, 361. Self-sharpening disk cutting elements 321, 331, 351 can penetrate formation material more easily and disintegrate nascent rock teeth between adjacent radial tooth impressions. These effects combine to provide a cutting structure that possesses increased ability to avoid tracking and balling conditions and results in more efficient and rapid penetration of formation material.

Furthermore, heel disk cutting elements 321, 351 very effectively kerf the gage surface or borehole sidewall, generating only relatively small quantities of undesirably fine cuttings, and cooperate with the remainder of heel and inner rows of cutting teeth 337, 341, 345, 361 to move cuttings away from the gage and toward fluid nozzle (17 in FIG. 1), which promotes the ability of earth-boring bit 311 to maintain gage and wash formation cuttings up the borehole 33.

The relatively wide and balanced spacing of disk cutting element 321, 331 and remaining heel and inner rows of cutting teeth 341, 361, 345, 337 on each of then respective cutters 313, 315, 317 promotes self-cleaning of cutter 313, 315, 317, and further aids in the avoidance of balling of earth-boring bit 311. The provision of heel row of cutting teeth 341 with variable pitch tooth spacing additionally aids in avoiding tracking conditions common to highly regularly spaced cutting teeth. The hard facing of the outermost surfaces of disk cutting elements 321, 331 provides differential wear of the elements and results in self-sharpening of those elements.

The earth-boring bit according to the present invention has a number of advantages. One advantage is the improved and increased rate of penetration of formation. Another advantage is that the bit has an improved ability to maintain the gage or outer diameter of the borehole being drilled through the self-sharpening characteristics of the disk cutting elements. This advantage provides a more consistent borehole diameter, and permits maintenance of high penetration rates over the life of the bit. Yet another advantage is that the bit runs cooler and longer because it is less prone to balling.

The invention has been described with reference to preferred embodiments thereof. Those skilled in the art will appreciate that the present invention is susceptible to variation and modification without departing from the scope and spirit thereof.

We claim:

1. An earth-boring bit with an improved rate of penetration into earthen formations, the earth-boring bit comprising:

a bit body;

at least two cutters mounted for rotation on a bearing shaft depending from the bit body, each cutter having a base and a nose;

a heel disk cutting element disposed proximally to the base of at least one of the cutters and defined by a pair of generally oppositely facing disk surfaces that generally continuously converge to define a circumferential heel disk crest; and a plurality of cutting teeth having axial crests thereon arranged in a plurality of rows on at least a second of the cutters, the plurality of rows including a heel row.

2. The earth-boring bit according to claim 1 wherein the heel disk cutting element is on a first cutter and a second cutter and the heel row of axial cutting teeth is on a third cutter.

3. The earth-boring bit according to claim 1 further comprising an inner disk cutting element disposed intermediate the nose and the base of at least one of the cutters having a heel disk cutting element, the inner disk cutting element defined by a second pair of generally oppositely facing disk surfaces that generally continuously converge to define a circumferential inner disk crest.

4. The earth-boring bit according to claim 1 wherein the disk cutting element is a disk that defines a single, generally continuous circumferential crest.

5. The earth-boring bit according to claim 1 wherein the heel disk cutting element is an interrupted disk that defines a plurality of only circumferential cutting teeth, all of the circumferential cutting teeth having a single circumferential crest.

6. The earth-boring bit according to claim 1 wherein one surface of the first pair of generally oppositely facing disk surfaces is formed of a more wear-resistant material than that of another of the first pair of generally oppositely facing disk surfaces.

7. An earth-boring bit with an improved rate of penetration into earthen formations, the earth-boring bit comprising:

a bit body;

at least two cutters mounted for rotation on a bearing shaft depending from the bit body, each of the cutters having a base and a nose;

a heel disk cutting element disposed proximally to the base of at least one of the cutters and defined by a first pair of generally oppositely facing disk surfaces that generally continuously converge to define a circumferential heel disk crest;

an inner disk cutting element disposed intermediate the base and nose of at least the cutter having a heel disk cutting element, the inner disk cutting element defined by a second pair of generally oppositely facing disk surfaces that generally continuously converge to define a circumferential inner disk crest; and a plurality of cutting teeth having axial crests thereon arranged in a plurality of rows on at least another of the cutters, the plurality of rows including a heel row.

8. The earth-boring bit according to claim 7 wherein the inner disk cutting element is a disk that defines a single, generally continuous cutting tooth having a single, generally continuous, circumferential crest.

9. The earth-boring bit according to claim 7 wherein the inner disk cutting element is an interrupted disk that defines a plurality of only circumferential cutting teeth, all of the circumferential cutting teeth having a single circumferential crest.

10. The earth-boring bit according to claim 7 wherein the heel disk cutting element is an interrupted disk that defines a plurality of only circumferential cutting teeth, all of the circumferential cutting teeth having a single circumferential crest.

11. The earth-boring bit according to claim 7 wherein the heel disk cutting element is a disk that defines a single, generally continuous cutting tooth having a single, generally continuous, circumferential crest.

12. The earth-boring bit according to claim 7 wherein one disk surface pair of disk surfaces of the heel disk cutting element is formed of a more wear-resistant material than that of another disk surface of the pair of disk surfaces of the heel disk cutting element to provide a self-sharpening heel disk cutting element, and further wherein one of the pair of disk surfaces of the inner disk cutting element is formed of a more wear-resistant material than that of another disk surface of the pair of disk surfaces of the inner disk cutting element to provide a self-sharpening inner disk cutting element.

13. An earth-boring bit of the milled tooth variety having an improved rate of penetration into earthen formations, the earth-boring bit comprising:

a bit body;

three cutters, each cutter mounted for rotation on a bearing shaft depending from the bit body, each cutter having a base, a nose, and at least one of the cutters having a plurality of cutting teeth formed thereon in rows, at least a portion of the cutting teeth having axial crests thereon;

at least a first of the three cutters including:

an inner disk cutting element disposed intermediate the base and nose of the first cutter, the inner disk cutting element defining a circumferential inner disk crest; and a heel disk cutting element disposed proximally to the base of the first cutter, the heel disk cutting element defining a circumferential heel disk crest;

at least a second of the three cutters including a heel disk cutting element disposed proximally to the base of the second cutter, the heel disk cutting element defining a circumferential heel disk crest; and a third of the three cutters having at least a heel row of cutting teeth having axial crests.

14. The earth-boring bit according to claim 13 wherein the inner disk cutting element is a disk that defines a single, generally continuous circumferential inner disk crest.

15. The earth-boring bit according to claim 13 wherein the inner disk cutting element on the second cutter is an interrupted disk that defines a plurality of cutting teeth, each cutting tooth having a single circumferential heel disk crest.

16. The earth-boring bit according to claim 13 wherein each of the three cutters is provided with an inner disk cutting element and each cutter is provided with at least one axial tooth crest.

17. The earth-boring bit according to claim 13 wherein the heel disk cutting element on the second cutter is an interrupted disk that defines a plurality of cutting teeth, each cutting tooth having a single circumferential heel disk crest.

18. The earth-boring bit according to claim 13 wherein one of the pair of disk surfaces of the heel disk cutting element is formed of a more wear-resistant material than that of another of the pair of disk surfaces of the heel disk cutting element to provide a self-sharpening heel disk cutting element.

19. The earth-boring bit according to claim 13 wherein one of the pair of disk surfaces of the inner disk cutting element is formed of a more wear-resistant material than that of another of the pair of disk surfaces of the inner disk cutting element to provide a self-sharpening inner disk cutting element.

20. The earth-boring bit according to claim 13 wherein a third cutter includes a heel row of cutting teeth having axial crests disposed proximally to the base of the third cutter, the heel row having a plurality of the cutting teeth having a pitch larger than a remainder of the cutting teeth in the heel row to provide irregular cutting tooth spacing.

21. The earth-boring bit according to claim 13 wherein a third of the three cutters includes an inner disk cutting element disposed intermediate the base and nose of the third cutter the inner disk cutting element defining a circumferential inner disk crest.

* * * * *